US008354144B2

(12) United States Patent
Grynaeus et al.

(10) Patent No.: US 8,354,144 B2
(45) Date of Patent: Jan. 15, 2013

(54) THERMOFUSIBLE TEXTILE FABRIC

(75) Inventors: Peter Grynaeus, Birkenau (DE); Oliver Staudenmayer, Weinheim (DE); Steffen Kremser, Heddesheim (DE); Holger Koehnlein, Weinheim (DE)

(73) Assignee: Carl Freudenberg KG, Weinheim (DE)

( * ) Notice: Subject to any disclaimer, the term of this patent is extended or adjusted under 35 U.S.C. 154(b) by 273 days.

(21) Appl. No.: 12/742,231

(22) PCT Filed: Nov. 10, 2008

(86) PCT No.: PCT/EP2008/009480

§ 371 (c)(1),
(2), (4) Date: May 10, 2010

(87) PCT Pub. No.: WO2009/059801

PCT Pub. Date: May 14, 2009

(65) Prior Publication Data

US 2010/0272912 A1 Oct. 28, 2010

(30) Foreign Application Priority Data

| | | |
|---|---|---|
| Nov. 9, 2007 | (DE) | 10 2007 053 914 |
| Dec. 21, 2007 | (DE) | 10 2007 062 865 |
| Apr. 30, 2008 | (EP) | 08008246 |
| Oct. 8, 2008 | (DE) | 20 2008 013 239 |

(51) Int. Cl.
*B05D 3/02* (2006.01)

(52) U.S. Cl. ..... 427/389.9; 427/256; 427/280; 427/288; 427/392; 427/394; 427/396

(58) Field of Classification Search ..... None
See application file for complete search history.

(56) References Cited

U.S. PATENT DOCUMENTS

| | | | | |
|---|---|---|---|---|
| 3,228,790 | A | 1/1966 | Sexsmith et al. | |
| 5,290,594 | A * | 3/1994 | Groshens et al. | 427/244 |
| 5,403,640 | A | 4/1995 | Krishnan et al. | |
| 5,505,999 | A | 4/1996 | Krishnan et al. | |
| 5,569,348 | A | 10/1996 | Hefele | |
| 8,135,997 | B2 | 3/2012 | Kim et al. | |
| 2009/0100565 | A1 | 4/2009 | Grynaeus et al. | |

FOREIGN PATENT DOCUMENTS

| | | | |
|---|---|---|---|
| DE | 102005030484 | A1 | 1/2007 |
| EP | 0153443 | A2 | 9/1989 |
| EP | 0675183 | A1 | 10/1995 |

(Continued)

OTHER PUBLICATIONS

International Search Report for PCT/EP2008/006235 mailed on Mar. 13, 2009.

(Continued)

*Primary Examiner* — Erma Cameron
(74) *Attorney, Agent, or Firm* — Leydig, Voit & Mayer, Ltd.

(57) ABSTRACT

A method for forming a thermofusible sheet material includes providing a backing ply including a textile material and applying a mixture of a binder and a thermoplastic polymer to selected areal regions of the backing ply so as to form a two-layer bonding compound structure. The method further includes thermally treating the backing ply so as to dry the mixture and to sinter the thermoplastic polymer onto a surface of the backing ply.

16 Claims, 1 Drawing Sheet

FOREIGN PATENT DOCUMENTS

| | | | |
|---|---|---|---|
| GB | 1379660 | A | 1/1975 |
| GB | 1474455 | A | 5/1977 |
| JP | 9158055 | A | 6/1997 |
| JP | 2010532503 | A | 10/2010 |
| WO | WO 9506155 | A1 | 3/1995 |

OTHER PUBLICATIONS

International Search Report for PCT/EP2008/009480 mailed on Jul. 8, 2009.

Possnecker, Gerhard, Klebstoffe für Einlage, ITB Vleisstoffe—Technische Textilien, 1999,Heft 2, S.16-20.

DIN 54310; Test of Textiles; "Delamination of fusible interlining from the outer fabric"; Mechanical delamination test; DIN Deutsches Institut fuer Normung e. V., Berlin; pp. 1-9; Jul. 1980.

DIN EN ISO 6330:2010-01; "Textiles—Domestic washing and drying procedures for textile testing (ISO 6330-2012)"; DIN Deutsehes Institut fuer Narmung e. V., Berlin; pp. 1-40; Aug. 2012.

* cited by examiner

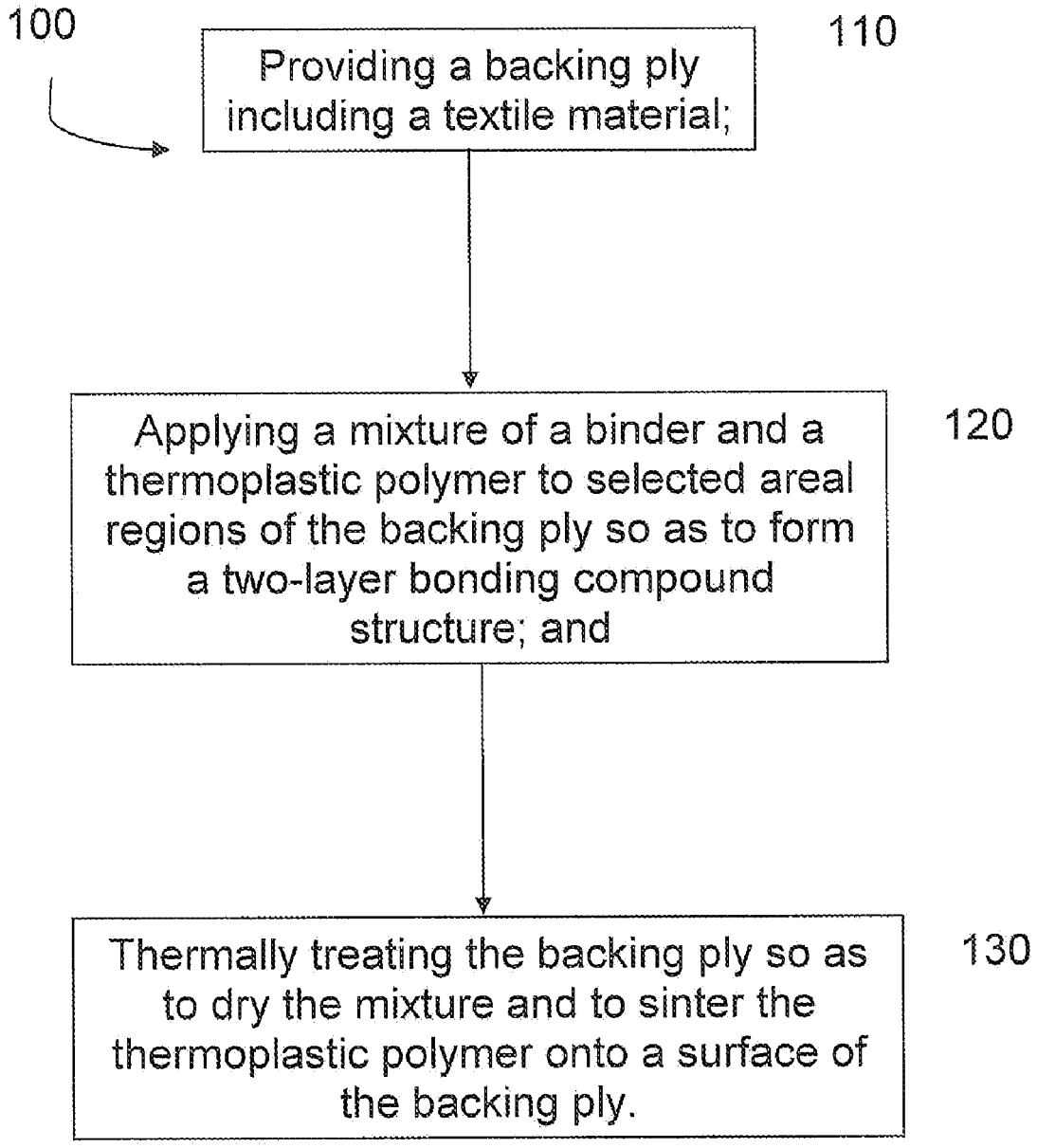
100
Providing a backing ply including a textile material;
110
Applying a mixture of a binder and a thermoplastic polymer to selected areal regions of the backing ply so as to form a two-layer bonding compound structure; and
120
Thermally treating the backing ply so as to dry the mixture and to sinter the thermoplastic polymer onto a surface of the backing ply.
130

THERMOFUSIBLE TEXTILE FABRIC

This application is a U.S. National Phase Application under 35 U.S.C. §371 of International Application No. PCT/EP2008/009480, filed Nov. 10, 2008, which claims benefit to German Patent Application No. DE 10 2007 053 914.4, filed Nov. 9, 2007, German Patent Application No. DE 10 2007 062 865.1, filed Dec. 21, 2007, European Patent Application No. EP 08 008 246.4, filed Apr. 30, 2008 and German Utility Application No. DE 20 2008 013 239.8, filed Oct. 8, 2008. The International Application was published in German on May 14, 2009 as WO 2009/059801 under PCT Article 21 (2).

This invention relates to a thermofusible sheet material, especially useful as a fusible interlining in the textile industry, having a backing ply composed of a textile material and supporting a two-layered bonding compound structure comprising a binder and a thermoplastic polymer.

BACKGROUND

Interlinings are the invisible scaffolding of clothing. They ensure correct fit and optimal wearing comfort. Depending on application, they augment processibility, enhance functionality and stabilize clothing. In addition to clothing, these functions can find application in industrial textile applications, for example furniture, upholstery and home textiles.

Important properties required of interlinings are softness, springiness, hand, wash and care durability and also adequate abrasion resistance on the part of the backing material in use.

Interlinings can consist of nonwovens, wovens, formed-loop knits or comparable textile sheet materials, which are usually additionally provided with a bonding compound whereby the interlining can be adhered to a top fabric usually thermally via heat and/or pressure (fusible interlining). The interlining is thus laminated onto a top fabric. The various textile sheet materials mentioned have different property profiles, depending on their method of making Woven fabrics consist of threads/yarns in the warp and weft directions, formed-loop knits consist of threads/yarns connected via a loop construction into a textile sheet material. Nonwovens consist of individual fibers laid down to form a fibrous web which are bonded mechanically, chemically or thermally.

In the case of mechanically nonwovens, the fibrous web is consolidated by mechanical interlacing of the fibers. This utilizes either a needling technique or an interlacing by means of jets of water or vapor. Needling does give soft products, albeit with relatively labile hand, so that this technology has become established for interlinings only in quite specific niches. In addition, mechanical needling requires typically a basis weight>50 g/m$^2$, which is too heavy for a multiplicity of interlining applications.

Nonwovens consolidated using jets of water can be produced in lower basis weights, but generally are flat and lack springiness.

In the case of chemically bonded nonwovens, the fibrous web is treated with a binder (an acrylate binder for example) by impregnating, spraying or by means of other customary methods of application, and subsequently cured. The binder bonds the fibers together to form a nonwoven, but has the consequence that a relatively stiff product is obtained, since the binder is widely distributed throughout the fibrous web and adheres the fibers together throughout as in a composite material of construction. Variations in hand/softness cannot be fully compensated via fiber blends or binder choice.

Thermally bonded nonwovens are typically calender or hot air consolidated for use as interlinings. The current standard technology for nonwoven interlinings is pointwise calender consolidation. The fibrous web here generally consists of polyester or polyamide fibers specifically developed for this process, and is consolidated by means of a calender at temperatures around the melting point of the fiber, one roll of the calender having a point engraving. Such a point engraving consists for example of 64 points/cm$^2$ and can have a sealing surface of 12% for example. Without a point arrangement, the interlining would be consolidated flattish and be unsuitably harsh in hand.

The above-described different processes for producing textile sheet materials are known and described in textbooks and in the patent literature.

The bonding compounds typically applied to interlinings are thermally activatable and consist generally of thermoplastic polymers. The technology for applying these bonding compound coatings is effected according to the prior art in a separate operation onto the fibrous sheet material. By way of bonding compound technology it is typically powder point, paste printing, double point, sprinkling, hotmelt processes which are known and described in the patent literature. Double point coating is currently considered to be the most effective with regard to adherence to the top fabric after caring treatment.

Such a double point has a two-layered construction in that it consists of an underpoint and an overpoint. The underpoint penetrates into the base material and serves as blocking layer against bonding compound strike-back and to anchor the overpoint particles. Customary underpoints consist of for example of binder. Depending on the chemistry used, the underpoint contributes as a blocking layer to the prevention of bonding compound strike back as well as to the anchoring in the base material. It is primarily the overpoint composed of a thermoplastic material which is the main adhesive component in the two-layered composite and which is sprinkled as a powder onto the underpoint. After sprinkling, the excess portion of the powder (between the points of the lower layer) is sucked off again. After subsequent sintering, the overpoint is (thermally) bonded on the underpoint and can serve as adhesive material in respect of the top fabric.

Depending on the intended purpose of the interlining, different numbers of points are printed and/or the amount of bonding compound or the geometry of the point pattern is varied. A typical number of points is, for example, CP 110 for an add-on of 9 g/m$^2$, or CP 52 having an add-on rate of 11 g/m$^2$.

Double-point technology is disadvantageous in that it requires very considerable machinery and invest, since the thermoplastic overpoint material first has to be sprinkled on and then the excess between the points of bonding compound has to be sucked off again, which is inconvenient and costly. If this operation is not accomplished to a sufficient degree, or not at all, unwanted hand harshenings can occur after fusing in the interlining/top fabric laminate, and soiling of the top fabric due to shedded loose polymeric particles and interply sticking due to the absent blocking layer may occur.

Paste printing is also widely used. In this technology, an aqueous dispersion is prepared from thermoplastic polymers, typically in particulate form having a particle size<80 μm, thickeners and flow control agents and is then applied in paste form to the backing ply usually in the form of points by means of a rotary screen printing process. The printed backing ply is subsequently subjected to a drying operation. Paste printing for applying the bonding compound is less good than the double point process in terms of bonding performance and in bonding compound strike-back because of the absent blocking layer.

SUMMARY OF THE INVENTION

An aspect of the present invention is to provide a textile fusible sheet material, especially for use as a fusible interlining in the textile industry, which has very good haptic and optical properties and very high bond strength to a top fabric and, what is more, is simple and inexpensive to produce.

According to the invention, a thermofusible sheet material, especially useful as a fusible interlining in the textile industry, having a backing ply composed of a textile material and supporting a two-layered bonding compound structure comprising a binder and a thermoplastic polymer is characterized in that it is obtainable by a process having the steps of:

a) providing the backing ply, b) applying a liquid-based mixture of the binder and the thermoplastic polymer, preferably an aqueous dispersion/paste of the binder and the thermoplastic polymer, to selected areal regions of the backing ply, and c) thermally treating the backing ply obtained from step b) and supporting the mixture to dry and optionally crosslink the binder and to sinter the thermoplastic polymer onto/with the surface of the backing ply supporting the binder.

BRIEF DESCRIPTION OF THE DRAWINGS

The FIGURE shows a preferred process for producing a thermofusible sheet material according to the present invention.

DETAILED DESCRIPTION

The thermofusible sheet material of the present invention is notable for high bond strength. It has been determined that, surprisingly, a bonding point composed of binder and thermoplastic polymer acting as the actual bonding compound has comparable bond strength to a bonding compound point of the double point technology described above. In contrast to the latter, however, the double point of the present invention can be applied in a single-step process. Because the thermoplastic polymer is applied in a mixture with binder and not in powder form, the process of the present invention—in contradistinction to double point technology—is completely free of the problem of contamination or unintended sticking due to shedded excess or polymeric powder. The costly and inconvenient step of sucking off is likewise eliminated. The thermofusible sheet material of the present invention is therefore simple and inexpensive to produce.

The choice of the material to be used for the backing ply, of the binder and of the thermoplastic polymer is made in view of the respective intended application and/or the particular quality requirements. The invention in principle imposes no limits here whatsoever. A person skilled in the art is readily able to find the combination of materials which is suitable for his or her purposes.

The backing ply consists, in accordance with the present invention, of a textile material, for example a woven fabric, or a knitted fabric or the like. Preferably, the backing ply consists of a nonwoven fabric.

The nonwoven fabric as well as the threads or yarns of the abovementioned further textile materials can consist of manufactured fibers or else of natural fibers. The manufactured fibers used are preferably polyester, polyamide, regenerated cellulose and/or binder fibers and the natural fibers, wool or cotton fibers.

The manufactured fibers may comprise crimpable, crimped and/or uncrimped staple fibers, crimpable, crimped and/or uncrimped directly spun continuous filament fibers and/or finite fibers, such as meltblown fibers.

The backing ply may have a single- or multi-ply construction.

Of particular suitability for interlinings are fibers having a fiber linear density of up to 6.7 dtex. Coarser linear densities are normally not used on account of their considerable fiber stiffness. Preference is given to fiber linear densities in the region of 1.7 dtex, but microfibers having a linear density<1 dtex are also conceivable.

The binder can be a binder of the acrylate, styrene-acrylate, ethylene-vinyl acetate, butadiene-acrylate, SBR, NBR and/or polyurethane type.

The thermoplastic polymer acting as actual bonding compound preferably comprises (co)polyester-, (co)polyamide-, polyolefin-, polyurethane-, ethylene vinyl acetate-based polymers and/or combinations (mixtures and chain growth addition copolymers) of the polymers mentioned.

The ratio of the amount of binder used to the amount of thermoplastic polymer and the variation of the wettability of the backing ply make it possible to obtain very severely bonded, abrasion-resistant products and very soft nonwoven fabrics having surfaces which can correspond to raised wovens. High proportions of thermoplastic polymer make it possible to achieve very high delamination resistances. By modifying the surface of the preferably particulate thermoplastic polymer, directly or indirectly from the liquor, its incorporation into the binder matrix can be varied. Very high occupation of the particle surface by other components of the binder matrix is deleterious to the bonding forces which are attainable.

The mixture of binder and thermoplastic polymer, which can be present in a liquid-based form, such as, for example, in the form of an aqueous dispersion, or in the form of a paste, is preferably applied to the backing ply in a point pattern, as described above. This ensures the softness and springiness of the material. The point pattern can be regularly or irregularly distributed. However, the present invention is in no way restricted to point patterns. The mixture of binder and thermoplastic polymer can be applied in any desired geometries, including for example in the form of lines, stripes, net- or lattice-type structures, points having rectangular, diamond-shaped or oval geometry or the like.

The FIGURE shows a preferred process 100 for producing a thermofusible sheet material according to the present invention. In a first step 110, a backing ply including a textile material is provided. In a second step 120, a mixture of a binder and a thermoplastic polymer is applied to selected areal regions of the backing ply so as to form a two-layer bonding compound structure. In a third step 130, the backing ply is thermally treated so as to dry the mixture and to sinter the thermoplastic polymer onto a surface of the backing ply The nonwoven fabric can be produced using the technologies described at the beginning The bonding of the fibers of the fibrous web to form a nonwoven fabric can be effected mechanically (conventional needling, water jet technology) by means of a binder or thermally. However, a moderate nonwoven fabric strength is sufficient for the backing ply prior to printing, since in the course of being printed with the mixture of binder and thermoplastic polymer the backing ply is additionally binder treated and consolidated. The moderate strength needed for the nonwoven fabric can also be achieved using inexpensive fiber raw materials, provided they meet the hand requirements. Process management can also be simplified. The binder in the dispersion helps to anchor the polymeric particles to the backing ply.

When staple fibers are used, it is advantageous to card them with at least one roller card to form a fibrous web. Random lapping is preferable here, but combinations of longitudinal and/or transverse lapping and/or even more complicated roller card arrangements are also possible when specific nonwoven fabric properties are to be made possible, and/or when multi-ply fibrous structures are desired.

The backing ply made of a textile material or of a nonwoven fabric can be printed with the dispersion comprising the binder and the thermoplastic polymer directly in a printing machine. It can possibly be sensible for this purpose for the backing ply prior to printing to be wetted with textile auxiliaries or treated in any other desired manner so as to render the printing operation more consistent.

Preferably, the mixture for printing is present in the form of a dispersion.

The dispersion used preferably comprises

- crosslinking or crosslinkable binders of the acrylate, styrene-acrylate, ethylene-vinyl acetate, butadiene-acrylate, SBR, NBR and/or polyurethane type, and also
- auxiliaries
  - such as thickeners (for example partially crosslinked polyacrylates and salts thereof),
  - dispersants,
  - wetting agents,
  - flow control agents,
  - hand modifiers (for example silicone compounds or fatty acid ester derivatives) and/or
  - fillers
- and one or more thermoplastic polymers acting as bonding compound.

The thermoplastic polymer is preferably present in the form of particles. It has been determined that, surprisingly, as the textile backing ply is printed with a dispersion of the particles and the binder and as the case may be still further components, the binder separates from the coarser particles and the coarser particles come to rest more on the upper side of the bonding area, for example the point surface. The binder, in addition to becoming anchored in the backing ply and also bonding said backing ply, also binds the coarser particles. At the same time, a partial separation of the particles and binder occurs at the surface of the backing ply. The binder penetrates more deeply into the material, while the particles accumulate at the surface. As a result, the coarser particles of polymer are bound into the binder matrix, but at the same time their free area at the surface of the nonwoven fabric is available for direct adhesive bonding to the top fabric. A structure resembling a double point comes to be developed but in contrast to the production of this structure in the known double point process, only a single process step is required and in addition the costly and inconvenient removal by suction of superfluous powder is no longer required.

Double-layered bonding compound points are notable for a low strike-back of bonding compound, since the layer applied first acts as a blocking layer. Surprisingly, the bonding point of the present invention, which resembles the double point, also displays this positive property. Evidently, the process described herein results in an in situ formation of a blocking layer in the bonding point; the strike-back of thermoplastic polymer is effectively braked; and the positive properties of the product are enhanced as a result.

The size of the particles is decided according to the area to be printed, for example the desired size of a bonding point. In the case of a point pattern, the particle diameter can vary between >0μ and 500μ. In principle, the particle size of the thermoplastic polymer is not unitary, but has a distribution, i.e., always has a spectrum of particle sizes. The limits recited above are the respective main fractions. The particle size has to be matched to the desired application rate, point size and point distribution.

The binders used can vary in their glass transition point, but for soft products it is customary to prefer "soft" binders having a Tg<10° C. The auxiliary materials serve to adjust the viscosity of the paste. Suitable binders make it possible to vary the haptics of the interlining between wide limits.

Following the printing operation, the material is subjected to a thermal treatment to dry and optionally crosslinking the binder and to sinter the thermoplastic polymer onto/with the binding layer and the surface of the backing ply, in particular the surface of the nonwoven fabric. Next the material is wound up.

One preferred use of the thermofusible textile fabric is the use as interlining in the textile industry. However, the use of a thermofusible textile sheet material of the present invention is not restricted to this application. Other applications are conceivable, for example as a fusible textile sheet material in home textiles such as upholstered furniture, reinforced seating structures, seat covers or as fusible and stretchable textile sheet material in automotive interiors, shoe components or the hygiene/medical sector.

The invention will now be described without loss of generality using the example of a thermofusible textile sheet material of the present invention being used as a fusible interlining in the textile industry.

Test methods used:

Fusing the hereinbelow described illustrative embodiments to an in-house top fabric of the popelin type was done on a continuous press at 140° C. and 12 sec. Delamination resistance is determined on the lines of DIN 54310 or DIN EN ISO 6330. The delamination resistance values recited are marked "sp" when, in the delamination resistance test, the adherence between top fabric and interlining is so powerful that the interlining tears in the course of the test being carried out before delamination is complete. This is a maximum value to be targeted, since the adherence is in principle stronger than the inner strength of the interliner.

To determine bonding compound strike-back, an inner sandwich formed from the interliner with the top fabric on the outside, is passed through the fusing press according to the above-reported settings. The lower the adherence of the inner ply, the lower the bonding compound strike-back.

1st Illustrative Embodiment

A fibrous web having a basis weight of 35 g/m$^2$ consisting of 100% of PES fibers 1.7 dtex/38 mm is roller carded. This fibrous web is point-consolidated at 221° C. in a calender with the bonding temperature on the smooth roll side being lowered by 5° C. compared with the standard process. This made it possible to achieve greater softness for the nonwoven fabric. The fibrous web weakly bonded to a nonwoven fabric next passes into a rotary screen printing machine at 110 points/cm$^2$ and is printed pointwise with a binder-polymer dispersion with an 18 g/m$^2$ (dry) add-on. The printed nonwoven fabric is dried in a belt dryer at 175° C., the binder crosslinks and the polymer particles are sintered on and together.

The binder-polymer dispersion has the following composition:

| | |
|---|---|
| Self-crosslinking butyl/ethyl acrylate binder disp. with $t_g$ = −12° C. | 12 parts |

-continued

| | |
|---|---|
| Copolyamide powder (particle diameter from >0 up to 160μ with melting region around 115° C. | 24 parts |
| Wetting agent a//n/I | 1 part |
| Thickener | 3 parts |
| Water | 60 parts |

2nd Illustrative Embodiment

A roller-carded fibrous web having a basis weight of 20 g/m$^2$ and consisting of 50% of nylon-6 fibers at 1.7 dtex 38 mm and 50% of PET (polyester) fibers at 1.7 dtex 34 mm is prewetted through a nozzle strip at 20 bar water pressure and the excess water is withdrawn down to a residual moisture content of 45%. Owing to the low pressure, consolidation is very weak compared with hydroentanglement consolidation. The fibrous web bonded to form a very soft nonwoven fabric next passes into a rotary screen printing machine at 110 points/cm$^2$ and is printed pointwise with a binder-polymer dispersion with a 9 g/m$^2$ add-on. The printed nonwoven fabric is dried in a belt dryer at 175° C., the binder crosslinks and the polymer particles are sintered on and together.

The binder-polymer dispersion has the following composition:

| | |
|---|---|
| Self-crosslinking butyl/ethyl acrylate binder disp. with $t_g$ = −28° C. | 9 parts |
| Copolyamide powder 60-130μ with melting region around 110° C. | 27 parts |
| Wetting agent a//n/I | 1 part |
| Dispersing agent | 2 parts |
| Thickener | 2 parts |
| Water | 59 parts |

3rd Illustrative Embodiment

A random-laid filament web having a basis weight of 40 g/m$^2$ and consisting of nylon-6 spun by the spunbond process is initially laid down on a collecting belt and then point-bonded through a pair of rolls similarly to example 2 at 190° C. to form a soft spunbond. The soft spunbond passes into a rotary screen printing machine with a screen at 37 points/cm$^2$ and is printed pointwise with a binder-polymer dispersion with a 16 g/m$^2$ add-on. The printed nonwoven fabric is then dried in a belt dryer at 175° C., the binder crosslinks and the polymer particles are sintered on and together.

The binder-polymer dispersion has the following composition:

| | |
|---|---|
| Self-crosslinking butyl/ethyl acrylate binder disp. with $t_g$ = −18° C. | 7 parts |
| Self-crosslinking butyl/ethyl acrylate binder disp. with $t_g$ = −10° C. | 7 parts |
| Copolyamide powder 80-200μ with melting region around 120° C. | 32 parts |
| Wetting agent a//n/I | 1 part |
| Dispersing agent | 2 parts |
| Thickener | 1 part |
| Water | 50 parts |

The product properties of the textile sheet materials produced as per the illustrative embodiments are recited in Table 1. Table 2 shows a comparison between a textile sheet material as per Example 1 and a thermally bonded comparative example.

TABLE 1

| | Example 1 | Example 2 | Example 3 |
|---|---|---|---|
| Points/cm$^2$ | 110 | 110 | 37 |
| Fiber blend. | 100% standard PES | 50% PA6 50% standard PES | 100% PA6 spunbond |
| Web [g/m$^2$] | 35 | 25 | 40 |
| Binder + thermopl. polymer add-on [g/m$^2$] | 18 | 9 | 16 |
| | Primary adherence [N/5 cm] fused at 140° C./12 sec to PES-cotton fabric | | |
| 140° C./12 s/2.5 bar | 12.8 sp | 7.1 sp | 24.3 |
| | Post-care adherence [N/5 cm] fused at 120° C./12 sec to PES-cotton fabric | | |
| 1 × 40° C. wash | 10.8 sp | 6.3 sp | 21.0 |
| 1 × 60° C. wash | 10.1 sp | 5.6 sp | 18.3 |
| 1 × dry cleaning | 13.2 sp | 7.0 sp | 22.7 |
| | Bonding compound strike-back [N/10 cm] fused at 120° C./12 sec to PES-cotton fabric | | |
| Inner sandwich back-riveting (S-RV) | 0.32 | 0.16 | 1.1 |
| | Stress-strain characteristics | | |
| Maximum tensile force (HZK) along [N/5 cm] | 24 | 13 | 42 |
| HZ strength elongation (HZKD) along [%] | 12 | 14 | 27 |
| HZK across [N/5 cm] | 5.2 | 3.7 | 22 |
| HZKD across [%] | 26 | 22 | 34 |
| Abrasion resistance reverse side | very good | good | good |

TABLE 2

| | Example 1 | Thermally bonded in comparison with Example 1 |
|---|---|---|
| Web [g/m$^2$] | 35 | 100% PES std. 35 |
| Web + binder [g/m$^2$] | 41 | 40 |
| Polymer add-on [g/m$^2$] | 12 | 12 |
| 140° C./12 s/2.5 bar | 12.8 sp | 11.2 |
| 1 × 60° C. wash | 10.1 sp | 9.0 |
| 1 × dry cleaning | 13.2 sp | 10.1 |
| Inner sandwich back-riveting (S-RV) | 0.32 | 0.27 |
| HZK along [N/5 cm] | 24 | 18 |
| HZKD along [%] | 12 | 8 |
| HZK across [N/5 cm] | 5.2 | 2.9 |
| HZKD across[%] | 26 | 7 |
| Abrasion resistance reverse side | very good | good |

It is apparent from the values in the tables that all inventive textile sheet materials are notable for high mechanical strength and high elongation and good abrasion resistance coupled with high delamination resistances.

What is claimed is:

1. A method for forming a thermofusible sheet material useable for a lamination onto a top fabric, the method comprising:

providing a backing ply including a textile material;

applying a mixture of a binder and a thermoplastic polymer to selected areal regions of the backing ply, the thermoplastic polymer being present as particles in the mixture such that the binder penetrates more deeply into the textile material and the particles accumulate at a surface thereby forming a two-layer bonding compound structure; and thermally treating the backing ply so as to dry the mixture and to sinter the thermoplastic polymer onto the surface of the backing ply.

2. The method as recited in claim 1, further comprising crosslinking the binder.

3. The method as recited in claim 1, wherein the textile material includes a nonwoven fabric.

4. The method as recited in claim 3, wherein the nonwoven fabric includes at least one selected from the group consisting of staple fibers, directly spun continuous filament fibers, finite fibers, binder fibers and natural fibers, wherein the staple fibers and the directly spun continuous fibers are crimpable, crimped or uncrimped and the natural fibers include wool fibers and cotton fibers.

5. The method as recited in claim 3, wherein the nonwoven fabric includes meltblown fibers including at least one selected from the group consisting of polyester, polyimide and regenerated cellulose.

6. The method as recited in claim 1, wherein the backing ply includes fibers having a fiber linear density of <6.7 dtex.

7. The method as recited in claim 6, wherein the thermoplastic polymer includes at least one selected from the group consisting of polyester-, polyamide-, copolyester-, copolyamide-, polyolefin-, polyurethane-, and ethylene vinyl acetate-based polymers.

8. The method as recited in claim 1, wherein the particles have a diameter less than 500 μm.

9. The method as recited in claim 1, wherein the binder includes at least one selected from the group consisting of acrylate, styrene-acrylate, ethylene-vinyl acetate, butadiene-acrylate, styrene-butadiene rubber, nitrile rubber and polyurethane type binders.

10. The method as recited in claim 1, wherein applying step includes applying the mixture in a form of a dispersion.

11. The method as recited in claim 10, wherein the dispersion includes auxiliaries.

12. The method as recited in claim 11, wherein the auxiliaries include at least one of thickeners, dispersants, wetting agents, flow control agents, hand modifiers and fillers.

13. The method as recited in claim 12, wherein the applying step includes applying the dispersion using a screen printing process.

14. The method as recited in claim 12, wherein the applying step includes applying the dispersion to the backing ply in one of a regularly and irregularly distributed pattern of points.

15. The method as recited in claim 1, wherein the particles are not unitary and are in a distribution in the mixture with different particle sizes of between >0 and 500 μm.

16. The method as recited in claim 15, wherein the distribution of the particles is in a range selected from the group consisting of between >0 and 160 μm, between 60 and 130 μm and between 80 and 200 μm.

* * * * *